US006119274A

United States Patent [19]

Graham

[11] Patent Number: 6,119,274

[45] Date of Patent: Sep. 19, 2000

[54] ARTICLE OF APPAREL

[76] Inventor: Lewis V. Graham, P.O. Box 521, Califon, N.J. 07830

[21] Appl. No.: 09/357,238

[22] Filed: Jul. 19, 1999

[51] Int. Cl.[7] ..... A41D 17/02; A41D 1/08

[52] U.S. Cl. ..... 2/242; 2/227; 36/2 R

[58] Field of Search ..... 2/22, 23, 242, 2/227, 61, 62, 231, 232, 214, 270; 36/2 R

[56] References Cited

U.S. PATENT DOCUMENTS

| | | | |
|---|---|---|---|
| 1,641,487 | 9/1927 | Hockmeyer | 36/2 R |
| 1,685,991 | 10/1928 | Erickson | 36/2 R |
| 1,691,057 | 11/1928 | Greilich | 36/2 R |
| 2,442,507 | 6/1948 | Murphy | 36/2 R |
| 2,967,308 | 1/1961 | Feese, Jr. | 2/227 |
| 5,033,124 | 7/1991 | Bucalo et al. | 2/242 |
| 5,033,126 | 7/1991 | Wruchk et al. | 2/242 |
| 5,170,503 | 12/1992 | Hightower, Jr. et al. | 2/22 |

FOREIGN PATENT DOCUMENTS

| | | | |
|---|---|---|---|
| 1234736 | 7/1902 | France | 2/242 |

*Primary Examiner*—Amy B. Vanatta
*Attorney, Agent, or Firm*—Bernard J. Murphy

[57] ABSTRACT

The article of apparel disclosed is a pair of full chaps formed of a substantially inelastic material, and having strips of elastomeric fabric interposed between the teeth of the closing zipper and the edges of the chaps material, to facilitate a continuous form-fit of the chaps no matter how the legs of the wearer flex. Additionally, elastomeric gussets are fixed across cut-outs in the chaps, also to accommodate and insure a maintained form-fit.

9 Claims, 1 Drawing Sheet

FIG. 2
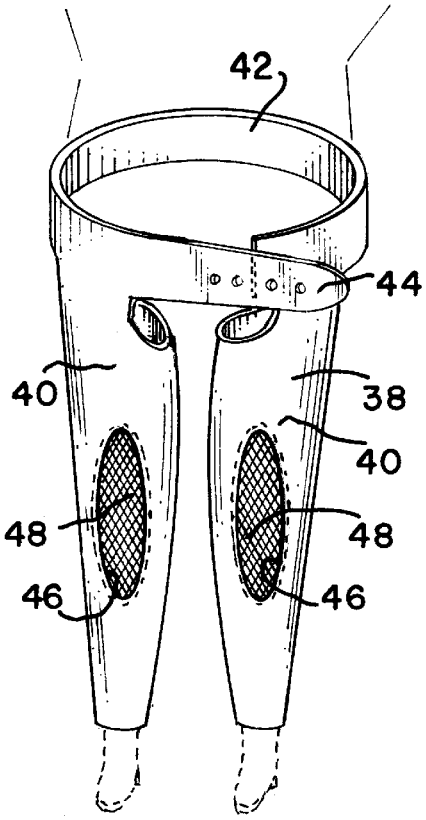
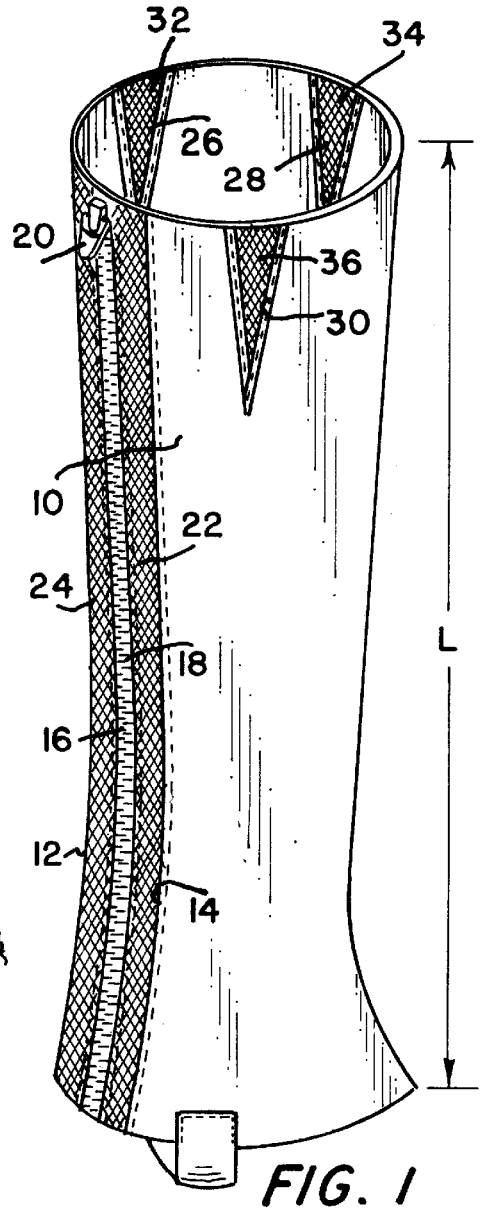
FIG. 1
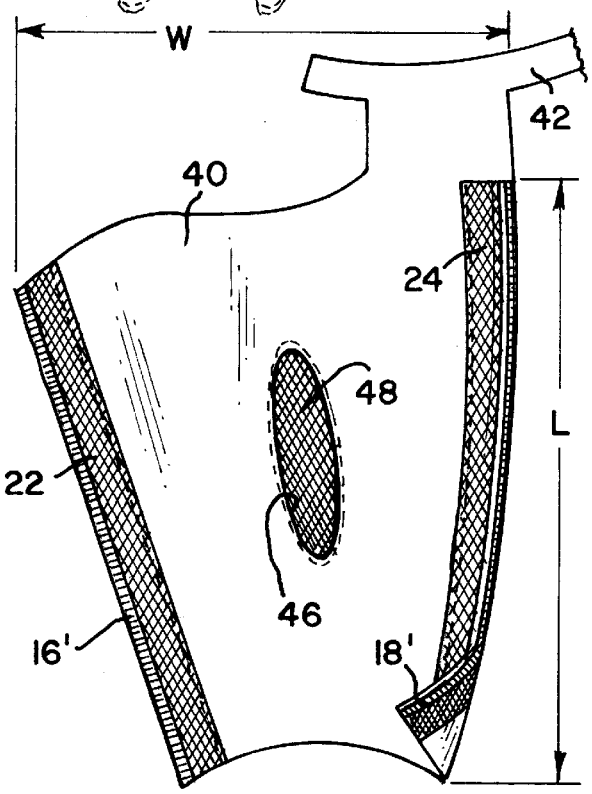
FIG. 3

ARTICLE OF APPAREL

This invention pertains to personal attire, or apparel, and in particular, by way of example, to chaparejos (which are more comonly known by the contraction: chaps), namely trousers, which are worn over ordinary trousers or pants, when riding a saddled horse, to protect the legs of the rider.

Chaps tend to be inflexible, heavy, and susceptible to creep and bunching up rending them quite uncomfortable. Over time, if the chaps are made of leather, they stretch somewhat, and this adversely affects the fit.

Now, it is quite necessary for the chaps to exhibit a good form fit, and where the legs of the rider expand and contract, due to muscular movement, and/or flexure of the knees, it is desirable for the chaps to expand and contract, correspondingly, thereby to maintain a desired form fit continuously. However, as noted, the known chaps can creep and bunch up, for having no significant elasticity.

It is known in clothing, personal attire or apparel, to manufacture such with gussets, at the waist, or shoulders, etc., to accommodate for stretch or flexure of the waist, limbs, and the like. However, with relaxation of the torso, or limbs, the gussets do not contract; they accommodate expansion, only. Accordingly, while it may seem that clothing gussets effect a form fit in an expanded condition of the gusseted article of apparel, they do not effect a form fit in a contracted condition of the body of the wearer. The gusset will enable free extension, for instance, of an arm out to the side of the body, but with a return of the arm to the side of the body, the gusset simply must bulge up.

What has been a long-felt need is for apparel, for instance: chaps, to be able to expand and contract with the limbs, sufficiently, to maintain a good form fit. In this way, the garment, the apparel, namely: the chaps will, then, not bunch up, and creep. To date then there has been an unmet need for an article of apparel comprising compliant material, substantially inelastic, of sufficient areal measure substantially to gird at least a significant, elongated portion of at least one leg of a person, and further wherein said material has a discontinuous elongate portion, for extending along such a leg portion, having a length which is at least equal to the width of said material; first means, joined to said material, manipulative for clasping said material about such a leg portion; and second means, cooperative with said first means, for effecting both (a) an expanded, form-fitting of said material about such a leg portion, and (b) a contracted, form-fitting of said material about such a leg portion.

It is an object of this invention, therefore, to set forth just such a long-sought article of apparel as aforesaid.

Further objects of this invention, as well as the novel features thereof, will become apparent by reference to the following description, taken in conjunction with the accompanying figures, in which:

FIG. 1 is a perspective illustration of a half chap, according to an embodiment of the invention;

FIG. 2 is a perspective depiction, in reduced scale as compared to FIG. 1, of full chaps, also according to the invention; and FIG. 3 is an enlarged-scale illustration of an opened leg portion of the chaps of FIG. 2.

The half chap 10, shown in FIG. 1, by way of example, is formed of leather, and has a width which is adequate to gird a significant, elongated portion of a leg of a person, and the length, L, thereof is greater than the width of the half chap material, as the illustration evidences. The leather material has two, confronting edges 12 and 14, and to these edges are attached the mating rows of teeth 16 and 18 of a zipper, the latter having the conventional slider 20 operative for causing the teeth of the rows 16 and 18 to engage and disengage, to cause the material to be clasped about the leg portion, or to open the chap 10, to remove the same from the leg. The zipper rows 16 and 18 are joined to the edges 12 and 14 by elastomeric strips of fabric 22 and 24. Consequently, length-wise of the chap 10, the material is caused to effect a form fit about the enclosed leg portion and, however the musculature of the leg may expand and contract, the strips of fabric 22 and 24 will maintain a form fit of the chap 10 about the enclosed leg.

In addition to the form-fitting-enabling elastomeric strips of fabric 22 and 24, the half chap also has cut-outs 26, 28 and 30, formed therein in the upper end thereof. Same elastomeric fabric 32, 34 and 36 is stitched to the edges of the cut-outs 26, 28, and 30 to bridge across the cut-outs and to provide more form-fitting accommodation in the half chap 10, as elastic gussets.

As noted, the half chap 10 is formed of leather; actually, in this embodiment of the invention, half chap 10 is formed of suede leather. Now, the invention is not limited to the use of leather, suede leather, or such, in its practice. FIGS. 2 and 3 depict an embodiment of the invention in which the chaps—here, full chaps 38—are formed of a denim, cotton material.

Chaps 38 has two legging portions 40, as is conventional, the same depending from a waistband 42 which has a belt tongue 44 for cinching up to a buckle (not shown). Each of the leggings 40, as shown in FIG. 3 has a width W, and a length L in which the length, L, is at least equal to the width, W; as shown, in fact, the length, L, is greater than the width, W.

Each legging 40 has a cut-out 46 formed therein, in the area whereat the knee of a wearer would locate. Again, elastomeric fabric 48 is stitched to the edges of the cut-outs 46 to bridge across the cut-outs to provide the form-fitting accommodation of the chaps. With a wearer of the chaps 38 standing erect, the leggings 40 are form-fitting. Then, with the wearer bending the knees, the elastomeric fabric 48 facilitates a constant form-fit of the leggings 40, with the knees flexed. Yet, upon the legs being straightened, the fabric 48 contracts to maintain the form-fit of the leggings 40.

Chaps 38, the same as disclosed for the half chap 10 of FIG. 1, have in each legging 40 rows of teeth 16' and 18' of a zipper and a slider (not shown), for engaging and disengaging the teeth to close each legging 40 about a leg of a wearer.

While I have disclosed my invention in connection with specific embodiments thereof, it is to be clearly understood that this is done only by way of example, and not as a limitation to the scope of the invention as set forth in the objects thereof, and in the appended claims.

I claim:

1. An article of apparel, comprising:

a single piece of compliant material, substantially inelastic, of sufficient areal measure substantially to gird at least a significant, elongated portion of at least one leg of a person; wherein said material has a discontinuous elongated portion, for extending along such a leg portion, having a length which is at least equal to the width of said material;

first means, joined to said material, manipulative for clasping said material about such a leg portion; and second means, cooperative with said first means, for effecting both (a) an expanded, form-fitting of said material about such a leg portion, and (b) a contracted, form-fitting of said material about such a leg portion; wherein said material comprises (a) a pair of legging portions, and (b) has sufficient expanse to gird at least significant, elongated portions of both legs of a person.

2. An article of apparel, according to claim 1, wherein:

said material has a cut-out formed therein; and said second means comprises an elastomeric fabric bridging across said cut-out.

3. An article of apparel, according to claim 2, wherein:

said second means comprises a gusset.

4. An article of apparel, according to claim 1, wherein:

said first means comprises a fastener having two rows of interengageable teeth, and a slider, engaged with said rows, operative for causing said teeth to engage and disengage;

said material has confronting edges; and said second means is (a) interposed between, and (b) coupled to said edges, and to said rows of teeth.

5. An article of apparel, according to claim 1, wherein:

said material has cut-outs formed therein; and said second means comprises elastomeric fabric bridging across said cut-outs.

6. An article of apparel, according to claim 1, wherein:

said material is leather.

7. An article of apparel, according to claim 1, wherein:

said material is suede leather.

8. An article of apparel, according to claim 1, wherein:

said material is cotton fabric.

9. An article of apparel, according to claim 1, wherein:

said article is a pair of full chaps.

* * * * *